US005188709A

United States Patent [19]

Kuerston et al.

[11] Patent Number: 5,188,709

[45] Date of Patent: Feb. 23, 1993

[54] CRUDE OIL PROCESSING APPARATUS FOR HEAVY OIL EXTRACTION

[75] Inventors: Richard D. Kuerston; Ronald E. Brown, both of Bartlesville, Okla.

[73] Assignee: Phillips Petroleum Company, Bartlesville, Okla.

[21] Appl. No.: 609,264

[22] Filed: Nov. 5, 1990

Related U.S. Application Data

[62] Division of Ser. No. 502,504, Mar. 30, 1990, Pat. No. 4,992,162.

[51] Int. Cl.[5] ..... C10G 21/14

[52] U.S. Cl. ..... 196/14.52; 196/135; 202/169; 203/43; 203/DIG. 9; 203/DIG. 19; 208/309; 208/311; 208/312; 208/321; 208/337; 208/354

[58] Field of Search ..... 196/14.52, 106, 127, 196/135; 202/169, 168, 153; 203/74, 81, DIG. 9, DIG. 19, 43–46; 208/308, 309, 311, 321, 322, 337, 347, 354, 312, 41, 45, 177

[56] References Cited

U.S. PATENT DOCUMENTS

| | | | |
|---|---|---|---|
| 2,614,971 | 10/1952 | Burton | 203/43 |
| 2,730,558 | 1/1956 | Gerhold | 208/321 |
| 2,777,800 | 1/1957 | Mitchell et al. | 196/14.47 |
| 2,801,957 | 8/1957 | Ray | 208/322 |
| 2,850,431 | 9/1958 | Smith | 208/321 |
| 2,940,920 | 6/1960 | Garwin | 208/45 |
| 3,117,079 | 1/1964 | Harper | 208/341 |
| 3,723,256 | 3/1973 | Thompson | 203/43 |
| 3,816,496 | 6/1974 | Schnabel | 203/43 |
| 4,522,710 | 6/1985 | Achia et al. | 208/349 |
| 4,702,819 | 10/1987 | Sharma et al. | 203/DIG. 19 |
| 4,722,769 | 2/1988 | Chan et al. | 203/DIG. 19 |

OTHER PUBLICATIONS

Nelson, W. L. "The Refiner's Notebook: Solvent Manufacture", *The Oil and Gas Journal*, Mar. 10, 1945, p. 83.

Kobe K. A. and J. J. McKetta, Jr., *Advances in Petroleum Chemistry and Refining*, vol. 5, p. 284. Interscience Publishers: 1962.

Sinkar, S. R., "Design, uses of modern SDA process", *The Oil and Gas Journal*, Sep. 30, 1974, pp. 56–64.

*Primary Examiner*—Wilbur Bascomb, Jr.

*Attorney, Agent, or Firm*—Laney, Dougherty, Hessin & Beavers

[57] ABSTRACT

The present invention provides an apparatus for preparing and treating a heavy oil extraction solvent. A solvent fraction is separated from a crude oil and combined with a slip stream of rerun solvent taken from an extraction process solvent recycle system. The solvent fraction and rerun solvent are fractionated to provide a purified extraction solvent. The purified extraction solvent is then utilized in the heavy oil extraction process.

8 Claims, 1 Drawing Sheet

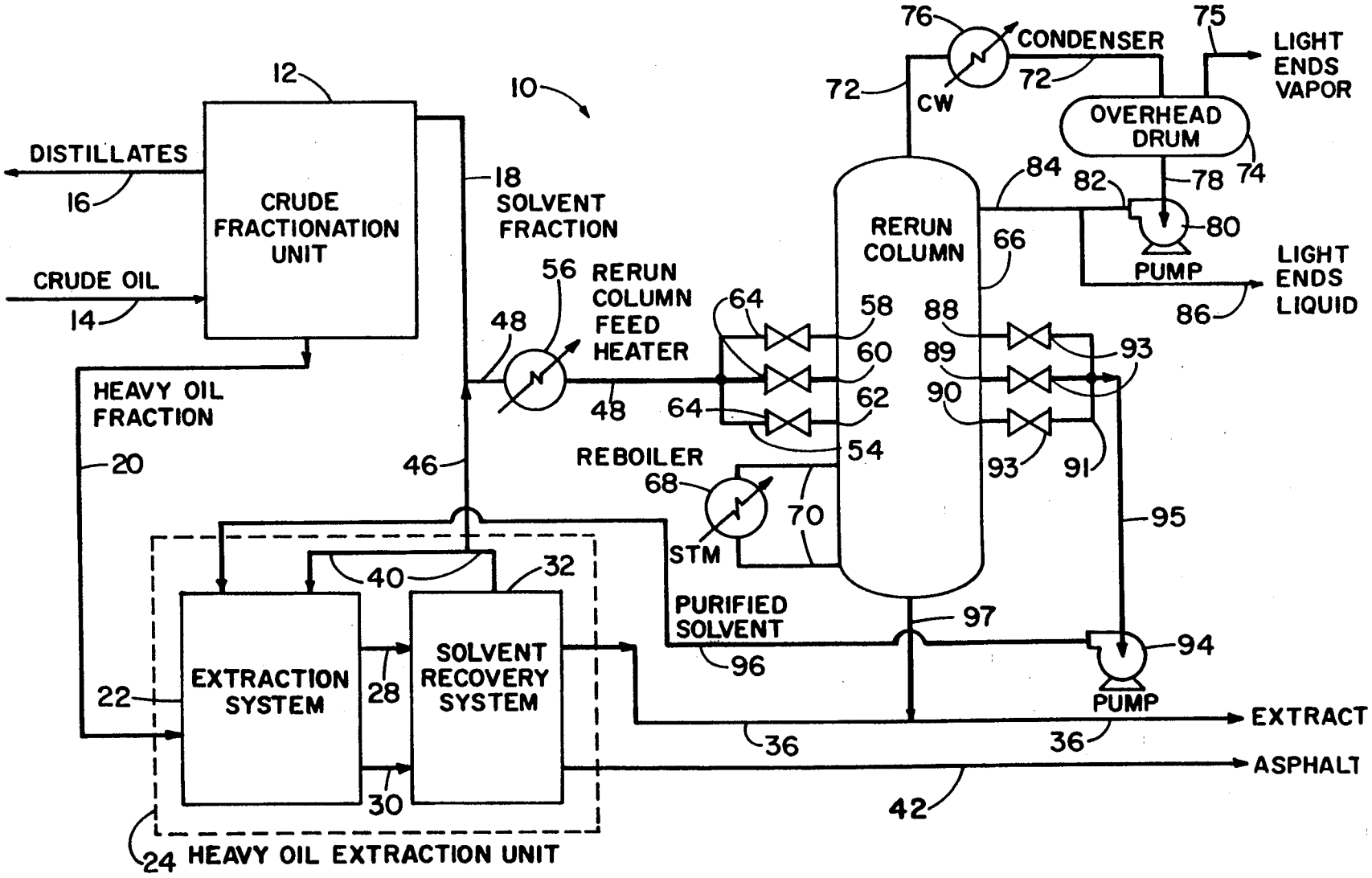
LIGHT ENDS VAPOR
LIGHT ENDS LIQUID
EXTRACT
ASPHALT
OVERHEAD DRUM
PUMP
CONDENSER
CW
RERUN COLUMN
REBOILER
STM
PURIFIED SOLVENT
RERUN COLUMN FEED HEATER
SOLVENT FRACTION
SOLVENT RECOVERY SYSTEM
EXTRACTION SYSTEM
HEAVY OIL EXTRACTION UNIT
CRUDE FRACTIONATION UNIT
DISTILLATES
CRUDE OIL
HEAVY OIL FRACTION
10
12
14
16
18
20
22
24
28
30
32
36
40
42
46
48
54
56
58
60
62
64
66
68
70
72
74
75
76
78
80
82
84
86
88
89
90
91
93
94
95
96
97

CRUDE OIL PROCESSING APPARATUS FOR HEAVY OIL EXTRACTION

This is a divisional of copending application(s) Ser. No. 07/502,504 filed on Mar. 30, 1990 and now U.S. Pat. No. 4,992,162.

BACKGROUND OF THE INVENTION

1. Field of the Invention

The present invention relates generally to crude oil processing. In another aspect, the present invention relates to a method and apparatus for heavy oil extraction. In another aspect, the present invention relates to a method and apparatus for preparing and treating an extraction solvent.

2. Description of the Prior Art

Heavy oil extraction processes (otherwise known as solvent de-asphalting) have been used, for example, in the production of heavy lubricating oil fractions, hydrocarbon cracking feedstocks, and low sulfur fuel oil feedstocks. Heavy oil extraction typically utilizes light hydrocarbon solvents which selectively remove useful extracts from heavy oil crude fractions at low temperature. The extracts obtained are rich in paraffinic components and are relatively free of asphaltenes, metals, and high boiling aromatics. Following extraction, an asphalt bottoms product remains which can be used, for example, in the production of asphalt cement.

In the typical heavy oil extraction process, a heavy oil feedstock is contacted with a light hydrocarbon solvent in a countercurrent extraction unit. The heavy oil feedstock normally comprises reduced crude (crude residua) or vacuum reduced crude (vacuum residua) obtained from a crude fractionation unit. Suitable light hydrocarbon extraction solvents have been obtained from crude oil fractions by distillation, sulfur dioxide extraction, hydrogenation, and hydroforming.

Substantial heavy oil extraction unit operating costs are generated in providing a suitable extraction solvent and maintaining extraction solvent purity. In order to maintain sufficient extraction solvent purity, a slip stream of dirty recirculating solvent is withdrawn from the extraction process, as necessary, and fresh extraction solvent is added. The dirty solvent withdrawn from the extraction unit is typically combined with the extract product. Since the dollar value of the extraction solvent exceeds the dollar value of the extract product, the need to dump dirty extraction solvent into the extract product and add fresh make-up solvent creates a large unit operating expense.

The present invention provides a novel and economical method and apparatus for supplying a high purity extraction solvent and for maintaining solvent purity. The present invention combines the dirty solvent withdrawn from the extraction unit with a fresh solvent fraction obtained from a crude fractionation unit. The fresh solvent fraction and the dirty solvent are fractionated to provide a purified solvent make-up stream.

In addition to providing a high purity solvent and maintaining solvent purity, the present invention provides efficient and economical reclamation of used solvent; allows less rigorous solvent separations in the crude unit and the extraction unit; eliminates the need to buy high purity solvents for solvent make-up; and provides efficient and economical control of fresh solvent make-up.

SUMMARY OF THE INVENTION

The present invention provides a method and apparatus for heavy oil extraction. In the method of the present invention, a solvent fraction is separated from a crude oil and combined with rerun solvent from an extraction unit. The solvent fraction and the rerun solvent are distilled to provide a purified extraction solvent.

In a preferred embodiment of the method of the present invention, a heavy oil fraction is also fractionated from the crude oil and is conducted to the extraction unit. The purified extraction solvent is conducted to the extraction unit and utilized to obtain an extract from the heavy oil fraction.

The apparatus of the present invention comprises: a first fractionation means for fractionating a crude oil to provide a solvent fraction and a heavy oil fraction; a solvent extraction means for obtaining an extract from the heavy oil fraction; and a second fractionation means for fractionating rerun solvent from the extraction means and the solvent fraction to produce a purified extraction solvent. The apparatus of the present invention further comprises: a first conduit means for conducting the heavy oil fraction from the first fractionation means to the solvent extraction means; a second conduit means for conducting the solvent fraction from the first fractionation means to the second fractionation means; a third conduit means for conducting the rerun solvent from the solvent extraction means to the second fractionation means; and a fourth conduit means for conducting the purified extraction solvent from the second fractination means to the solvent extraction means.

It is therefore a general object of the present invention to provide a method and apparatus for heavy oil extraction.

A further object of the present invention is the provision of an economical and efficient method and apparatus for providing a purified extraction solvent and for maintaining extraction solvent purity.

A further object of the present invention is the provision of an economical and efficient method and apparatus for reclaiming and purifying used extraction solvent.

A further object of the present invention is the provision of an economical and efficient method and apparatus for controlling the quantity and purity of extraction unit makeup solvent.

Other and further objects, features, and advantages of the present invention will be readily apparent to those skilled in the art upon reference to the accompanying drawing and upon a reading of the description of the preferred embodiments which follows.

BRIEF DESCRIPTION OF THE DRAWING

The drawing schematically illustrates an embodiment of the apparatus of the present invention wherein a crude unit solvent fraction and an extraction unit rerun solvent are combined and purified in a rerun column.

DESCRIPTION OF THE PREFERRED EMBODIMENTS

Referring to the drawing, an embodiment of the apparatus of the present invention is illustrated and generally designated by the numeral 10. The apparatus 10 basically comprises: a first fractionation means for fractionating a crude oil to provide a solvent fraction and a heavy oil fraction (residua); a solvent extraction means for obtaining an oil extract from the heavy oil fraction; and a second fractionation means for fractionating rerun solvent from the solvent extraction means and the solvent fraction from the first fractionation means to produce a purified extraction solvent.

In apparatus 10, a crude oil is conducted to crude fractionation unit 12 by conduit 14 which is connected thereto. Conduit 14 is also connected to a source (not shown) of crude oil. In a typical crude fractionation unit, the crude oil is preheated by indirect heat exchange with the various fractions obtained from crude oil. The preheated crude oil is further heated in a crude furnace and then conducted to a crude fractionation tower. The crude fractionation tower operates at a pressure slightly exceeding atmospheric pressure. Various crude oil fractions (distillates) such as straight run gasoline, naphtha, kerosene, diesel, and atmospheric gas oil are withdrawn from the crude tower. These distillates are then cooled and conducted to storage or to other processing units as indicated by arrow 16.

A solvent fraction is also drawn from the crude fractionation tower and is conducted from crude fractionation unit 12 by conduit 18 which is connected to unit 12. The solvent fraction can comprise various hydrocarbons within the $C_1$ to $C_7$ alkane boiling range. Such hydrocarbons can include substituted and unsubstituted $C_1$ to $C_7$ alkanes, substituted and unsubstituted $C_2$ to $C_7$ alkenes, and various mixtures of these alkanes and alkenes. A solvent fraction stripper (not shown) can be disposed within conduit 18 to remove undesirable light ends and other contaminants from the solvent fraction.

Crude fractionation unit 12 can also contain a vacuum furnace and a vacuum fractionation tower. If crude fractionation unit 12 contains a vacuum furnace and vacuum fractionation tower, the bottoms product from the crude fractionation tower (crude residua) is withdrawn from the crude tower and heated in the vacuum furnace. After heating, the crude tower bottoms is further fractionated in the vacuum fractionation tower. In the vacuum tower, vacuum gas oil fractions are withdrawn from the crude residua at a pressure well below standard atmospheric pressure. Due to the vacuum conditions existing in the vacuum tower, the vacuum gas oil fractions can be separated from the crude residua at a greatly reduced temperature.

In apparatus 10, a heavy oil fraction is conducted by conduit 20 from crude fractionation unit 12 to extraction system 22 located in heavy oil extraction unit 24. Conduit 20 is connected between crude fractionation unit 12 and extraction system 22. Depending on the type of crude fractionation unit used, the heavy oil fraction can comprise either crude residua or vacuum residua. Suitable heavy oil fractions will generally comprise the portion of the crude oil characterized by a TBP cut point in the range of from about 650° F.+ to about 1050° F.+.

In extraction system 22, the heavy oil fraction is typically contacted with a light hydrocarbon solvent in a countercurrent extraction tower in order to obtain an extract from the heavy oil fraction. The countercurrent extraction tower operates at a pressure in the range of from about 400 psig to about 600 psig and a temperature in the range of from about 150° F. to about 400° F. A suitable light hydrocarbon extraction solvent is selected from substituted and unsubstituted alkanes having from about three to about seven carbon atoms, mixtures of such alkanes, substituted and unsubstituted alkenes having from about three to about seven carbon atoms, mixtures of such alkenes, and mixtures of these alkanes and alkenes. Preferably, the light hydrocarbon extraction solvent comprises at least about 50 mole % iso and/or normal pentane ($C_5$). This preferred pentane rich light hydrocarbon solvent will provide maximum oil and resin recovery while minimizing contaminant pick-up.

A solvent-extract mixture is conducted by conduit 28 from extraction system 22 to solvent recovery system 32. Conduit 28 is connected between extraction system 22 and solvent recovery system 32.

Following removal of the extract from the heavy oil fraction, the remainder of the heavy oil fraction comprises an asphalt material. If desired, this asphalt material can also be conducted to solvent recovery system 32 for solvent recovery. In apparatus 10, the asphalt material is conducted by conduit 30 from extraction system 22 to solvent recovery system 32. Conduit 30 is connected between extraction system 22 and solvent recovery system 32.

In solvent recovery system 32, light hydrocarbon solvent is recovered from the solvent-extract mixture and from the asphalt material. In a typical solvent recovery system, solvent is recovered from the solvent-extract mixture by the use of one or more solvent evaporators. These evaporators are generally kettle-type exchangers with U-tubes and steam heated foam breaker coils. Alternatively, solvent can be recovered from the solvent-extract mixture by using a series of flash vessels. Liquid extract is removed from the evaporators, or flash vessels, and is conducted to an extract stripper tower. In the extract stripper tower, steam is used to remove solvent remaining in the extract product. After stripping, the extract is conducted from solvent recovery system 32 by conduit 36 which is connected thereto. Conduit 36 conducts the extract to storage or to other processing units (not shown).

The asphalt material is conducted to another portion of solvent recovery system 32 where it is heated in an asphalt heater and then flashed in an asphalt flash drum. Vaporized solvent is separated from the asphalt material in the asphalt flash drum. Hot asphalt liquid is then conducted from the bottom of the asphalt flash drum to an asphalt stripper tower. In the asphalt stripper tower, steam is used to remove solvent remaining in the asphalt product. After stripping, the asphalt product is conducted from solvent recovery system 32 by conduit 42 which is connected thereto. Conduit 42 conducts the asphalt product to storage or to other processing units (not shown).

The overhead vapor from the asphalt stripper tower is typically combined with the overhead vapor from the extract stripper tower. This combined vapor stream which comprises solvent vapor and stripping steam, is cooled with cooling water in order to condense and remove the steam. After steam removal, the remaining solvent vapor is combined with the solvent vapor streams recovered from the solvent evaporators, or flash vessels, and the asphalt flash drum. The combined recovered solvent stream (solvent recycle) is condensed and then conducted by conduit 40 from solvent recovery system 32 to extraction system 22. Conduit 40 is connected between solvent recovery system 32 and extraction system 22.

A slip stream of rerun solvent is removed from the solvent recycle stream through conduit 46 which is connected to conduit 40. The amount of rerun solvent withdrawn from the solvent recycle is determined by the rate of contaminant build-up in the solvent recycle.

The build-up of extract and other contaminants in the solvent recycle reduces extraction efficiency in heavy oil extraction unit 24. The amount of rerun solvent removed from the solvent recycle is controlled by a conventional flow control apparatus (not shown) disposed within conduit 46.

The rerun solvent is conducted to conduit 48 by conduit 46 which is connected thereto. The solvent fraction removed from crude fractionation unit 12 is conducted to conduit 48 by conduit 18 which is also connected to conduit 48. The solvent fraction and rerun solvent are conducted to rerun column inlet manifold 54 by conduit 48 which is connected to manifold 54. Rerun column feed heater 56 is disposed within conduit 48 for heating the solvent fraction and rerun solvent by indirect heat exchange. In feed heater 56, the solvent fraction and rerun solvent can be heated, for example, by indirect heat exchange with steam, a process stream, or some other heat source.

The solvent fraction and rerun solvent are conducted by manifold 54 to one of feed nozzles 58, 60, or 62. Feed nozzles 58, 60, and 62 are connected to the side of rerun column 66 at different vertical locations. The feed nozzles are preferably located within about the middle vertical one-third of rerun column 66. Valves 64 are disposed between manifold 54 and feed nozzles 58, 60, and 62 so that the solvent fraction and rerun solvent can be directed to the desired feed nozzle. The feed nozzle selected will be that which promotes the greatest fractionation efficiency given the solvent feed composition and temperature, the configuration of rerun column 66, and the operating conditions of rerun column 66. Although three rerun column feed nozzles are shown in apparatus 10, the rerun column can have one or a plurality of feed nozzles.

The bottom of rerun column 66 is heated by reboiler 68. Reboiler 68 is disposed within conduit 70 which is connected at both ends to the bottom portion of rerun column 66. In reboiler 68, rerun column 66 bottoms are heated by indirect heat exchange with steam.

Rerun column 66 overhead vapor is conducted by conduit 72 from rerun column 66 to overhead drum 74. Conduit 72 is connected to the top of rerun column 66 and to overhead drum 74. Condenser 76 is disposed within conduit 72. In condenser 76, at least a portion of the rerun column overhead is condensed by indirect heat exchange with cooling water. Uncondensed rerun column overhead (i.e., light ends vapor) is conducted to storage or to other processing units (not shown) by conduit 75 which is connected to overhead drum 74. The amount of light ends vapor flowing through conduit 75 can be controlled by a conventional pressure control apparatus (not shown) disposed within conduit 75.

Condensed rerun column overhead material is conducted from overhead drum 74 to pump 80 by conduit 78 which is connected to overhead drum 74 and to the inlet of pump 80. Condensed rerun column overhead material is conducted from pump 80 by conduit 82 which is connected to the discharge of pump 80. A portion of the condensed material is conducted by conduit 84 from conduit 82 to the top of rerun column 66. Conduit 84 is connected between conduit 82 and rerun column 66. The condensed material conducted to the top of rerun column 66 serves as reflux for column 66. The remainder of the condensed rerun column overhead material (i.e., light ends liquid) is conducted to storage or to another processing unit (not shown) by conduit 86 which is connected to conduit 82.

The amount of reflux material utilized in rerun column 66 is determined by the composition of the rerun column 66 feed and the desired composition and purity of the purified solvent product. The reflux rate is controlled by a conventional temperature control apparatus (not shown) disposed within conduit 84. This temperature control apparatus controls the amount of reflux flowing to rerun column 66 based on the column 66 overhead temperature.

The amount of the light ends liquid removed through conduit 86 is controlled in order to maintain a proper liquid level in overhead drum 74. A conventional level control apparatus (not shown) is disposed within conduit 86 in order to control the light ends liquid flow rate. Both the light ends vapor and the light ends liquid comprise light hydrocarbon and other contaminants which were removed from the solvent fraction and the rerun solvent.

The internals of rerun column 66 can comprise valve trays, bubble cap trays, packing, or any suitable fractionation internals known in the art. The size of rerun column 66 will be determined by the scope of possible rerun column feeds; the fractionation efficiency of the chosen column internals; the desired composition scope of the purified solvent product; and the desired purity of the purified solvent product.

Purified solvent is withdrawn from rerun column 66 through any one of draw nozzles 88, 89, and 90. Draw nozzles 88, 89, and 90 are located at different heights along the side of rerun column 66. The draw nozzles are preferably located within about the middle vertical one-half of rerun column 66. Purified solvent from draw nozzles 88, 89, and 90 is conducted to draw manifold 91. Valves 93 are disposed between draw nozzles 88, 89, and 90, and manifold 91 to facilitate the withdrawal of purified solvent from a desired draw nozzle. Although three draw nozzles are shown in apparatus 10, one or a plurality of draw nozzles can be provided for rerun column 66. Draw nozzle selection will be governed by such factors as the feed composition, rerun column 66 operating conditions, and the desired purified solvent composition. For example, an upper draw nozzle should generally be used if the desired solvent is high purity propane while a lower draw nozzle should be used if the desired solvent is pentane.

Purified solvent drawn from rerun column 66 is conducted to pump 94 by conduit 95 which is connected between manifold 91 and the inlet of the pump 94. The purified solvent is conducted to extraction system 22 by conduit 96 which is connected between extraction system 22 and the discharge of pump 94. In extraction system 22, the purified solvent is combined with the solvent recycle. This combined solvent is then used in the countercurrent heavy oil extraction process described above.

The bottoms material which accumulates in the bottom of rerun column 66 is conducted by conduit 97 to conduit 36. Conduit 97 is connected between conduit 36 and the bottom of rerun column 66. The rerun column bottoms material combines with the extract product flowing through conduit 36 and is conducted from apparatus 10 as described above. The bottoms material conducted from rerun column 66 primarily comprises extract and heavy hydrocarbons removed from the solvent fraction and from the rerun solvent.

In the operation of apparatus 10, a crude oil is fractionated in crude fractionation unit 12 to provide a solvent fraction and a heavy oil fraction. Depending upon the composition of the crude, the solvent fraction will generally be selected from substituted and unsubstituted alkanes having from about one to about seven carbon atoms, mixtures of such alkanes, substituted and unsubstituted alkenes having from about two to about seven carbon atoms, mixtures of such alkenes, and mixtures of these alkanes and alkenes. The heavy oil fraction can be the bottom product from a crude tower operating at slightly above atmospheric pressure (crude residua). Alternatively, the heavy oil fraction can be the bottom product from a vacuum fractionation tower operating at a pressure well below atmospheric (vacuum residua). Suitable heavy oil fractions will generally comprise the portion of the crude oil characterized by a TBP cut point in the range of from about 650° F.+ to about 1050° F.+.

The heavy oil fraction is conducted to extraction system 22 located in heavy oil extraction unit 24. In extraction system 22, the heavy oil fraction is contacted with a light hydrocarbon solvent in a countercurrent extraction column in order to remove an extract. Following extraction, the remainder of the heavy oil fraction is conducted to solvent recovery system 32 located in heavy oil extraction unit 24. In solvent recovery system 32, solvent remaining in the heavy oil fraction is removed. Following extraction and solvent recovery, the remaining heavy oil fraction (asphalt) is conducted to storage or to another processing unit.

A solvent-extract mixture is conducted from the countercurrent extraction tower to another portion of solvent recovery system 32. In solvent recovery system 32, solvent is recovered from the solvent-extract mixture. Following solvent recovery, the extract is conducted to storage or to another processing unit. The solvent recovered from the solvent-extract mixture is combined with the solvent recovered from the asphalt product to form a solvent recycle stream. This solvent recycle is conducted back to extraction system 22 for reuse.

In order to maintain a suitable extraction solvent purity, a slip stream of rerun solvent is removed from the solvent recycle. This rerun solvent is combined with the solvent fraction obtained from crude fractionation unit 12. The solvent fraction and rerun solvent are heated by indirect heat exchange in rerun column feed heater 56. After heating, the solvent fraction and rerun solvent are distilled in rerun column 66.

In rerun column 66, light and heavy hydrocarbons and other contaminants are removed from the solvent fraction and the rerun solvent in order to provide a purified extraction solvent. The purified extraction solvent will generally comprise a hydrocarbon, or a mixture of hydrocarbons, selected from substituted and unsubstituted alkanes having from about three to about seven carbon atoms and substituted and unsubstituted alkenes having from about three to about seven carbon atoms. Preferably, the purified solvent will comprise at least about 50 mole % iso and/or normal pentane.

The overhead vapor produced in rerun column 66 is cooled and at least partially condensed in condenser 76. After cooling in condenser 76, the overhead material is conducted to overhead drum 74. A portion of the condensed overhead material is used as rerun column 66 reflux. The uncondensed overhead material (i.e., light ends vapor) and the remainder of the condensed overhead material (i.e., light ends liquid) are conducted to storage or to other processing units.

Heavy contaminants removed from the solvent fraction and rerun solvent accumulate in the bottom of rerun column 66. The heavy contaminants are conducted from the bottom of rerun column 66 and are combined with the extract product flowing from solvent recovery system 32. This combined stream is conducted to storage or to other processing units.

The purified solvent obtained from rerun column 66 is conducted to extraction system 22 where it is combined with the solvent recycle. The purified solvent and the solvent recycle comprise the solvent which is utilized in heavy oil extraction unit 24 to obtain an extract from the heavy oil fraction.

The following example is provided in order to further illustrate the present invention.

EXAMPLE

A 100,000 barrel per day (BPD) stream of 19.3° API Hondo crude is fractionated in crude fractionation unit 12 to provide 30,260 BPD of crude tower distillates and 25,800 BPD of vacuum tower distillates. In addition to these distillates, a 2,740 BPD solvent fraction stream is drawn from the crude fractionation unit 12 crude tower and a 41,200 BPD stream of vacuum residua is drawn from the bottom of the crude fractionation unit 12 vacuum tower. The solvent fraction comprises $C_7$ and lighter components while the vacuum residua comprises the heavy portion of the crude represented by a TBP cut point of 950° F.

The vacuum residua is conducted to extraction system 22 where it is contacted with 171,040 BPD of solvent in a counter-current extractor. Following extraction, 13,200 BPD of asphalt are withdrawn from the bottom of the countercurrent extractor and conducted to an asphalt stripper located in solvent recovery system 32. In the asphalt stripper, steam is used to remove any solvent remaining in the asphalt material. Stripped asphalt is withdrawn from the bottom of the steam stripper and conducted to storage or other processing units.

A solvent-extract mixture is withdrawn from the top of the counter-current extractor and conducted to solvent recovery system 32. Most of the solvent is removed from the solvent-extract mixture using a series of solvent evaporators. Hot extract liquid is removed from the evaporators and conducted to an extract stripper In the extract stripper, steam is used to remove any solvent remaining in the extract. 28,000 BPD of extract are withdrawn from the bottom of the extract stripper and conducted to storage or to other processing units.

The overhead vapor stream flowing from the top of the asphalt stripper is combined with the overhead vapor stream flowing from the top of the extract stripper. This combined vapor stream comprises vaporized solvent and stripping steam. The combined vapor stream is cooled with cooling water in order to condense and remove the stripping steam. The remaining solvent vapor is then combined with the solvent vapor flowing from the solvent evaporators to form a 171,040 BPD combined solvent vapor stream. The combined solvent vapor stream is then condensed by indirect heat exchange with cooling water. 170,580 BPD of the condensed solvent are conducted to extraction system 22 for use as recycled solvent. 460 BPD of the condensed solvent are conducted from the heavy oil extraction unit as rerun solvent.

The rerun solvent is combined with the solvent fraction drawn from the crude tower to form a rerun column feed stream. The composition of the rerun column feed stream is provided in Table I. The rerun column feed is heated to its bubble point (167° F.) in feed heater 56. Feed heater 56 operates at a pressure of about 102 psia.

After heating, rerun column feed is fractionated in rerun column 66. Rerun column 66 comprises 15 theoretical trays. Tray 1 is located at the bottom of rerun column 66 and tray 15 is located at the top of column 66. Rerun column feed is fed to tray 8 and purified solvent is drawn from tray 5. Rerun column 66 operates at an overhead temperature of 99° F. and an overhead pressure of about 100 psia. In the operation of rerun column 66, reboiler 68 provides a heat duty of 188.1 MMBTU per day. 171.6 MMBTU per day are removed from the rerun column overhead by condenser 76. Condenser 76 operates as a total condenser. Consequently, there is no light ends vapor product. Rerun column 66 is operated at a reflux ratio of approximately four barrels of reflux per barrel of light ends liquid product.

1,065 BPD of light ends liquid product are drawn from the rerun column overhead system and 1,675 BPD of bottoms product are drawn from the bottom of rerun column 66. The overhead product liquid is conducted to storage or to other processing units. The rerun column bottoms product is combined with the extract recovered in heavy oil extraction unit 24 and conducted to storage or to other processing units. The composition of the rerun column bottoms product is provided in Table I.

A 460 BPD stream of purified solvent is drawn from tray 5 of rerun column 66 at a temperature of 228° F. The composition of the purified solvent stream is provided in Table I. As seen in Table I, the purified solvent stream comprises a combined isopentane and n-pentane concentration of 65.7 mole %. The purified solvent stream is combined with the 170,580 BPD recycle solvent stream to form the 171,040 BPD solvent stream used for extraction in the counter-current extractor mentioned above.

TABLE I

RERUN COLUMN FEED AND PRODUCT COMPOSITIONS

| | Composition - Mole % | | |
|---|---|---|---|
| Components | Feed | Bottoms Product | Purified Solvent draw |
| Ethane | 0.89 | — | — |
| Propane | 10.75 | — | 0.05 |
| Isobutane | 5.09 | — | 0.31 |
| N-butane | 19.57 | — | 3.49 |
| Dimethylbutane | 1.59 | 3.07 | 1.57 |
| Isopentane | 12.30 | 13.29 | 30.29 |
| N-pentane | 16.46 | 22.81 | 35.41 |
| Methylpentane | 15.83 | 28.86 | 13.83 |
| Cyclopentane | 3.24 | 5.37 | 4.58 |
| Methylcyclopentane | 5.35 | 10.00 | 3.79 |
| N-hexane | 7.46 | 13.87 | 5.53 |
| Cyclohexane | 0.38 | 0.73 | 0.24 |
| Benzene | 1.09 | 2.00 | 0.91 |
| TOTAL | 100.00 | 100.00 | 100.00 |

Thus, the present invention is well adapted to carry out the objects and obtain the ends and advantages mentioned above as well as those inherent therein. While presently preferred embodiments have been described for purposes of this disclosure, numerous changes in the arrangement of method steps and apparatus parts can be made by those skilled in the art. Such changes are encompassed within the spirit of the invention as defined by the appended claims.

What is claimed is:

1. A crude oil processing apparatus, comprising:

first fractional distillation means for fractionating a crude oil, said crude oil including a fresh solvent fraction and a heavy oil fraction, to provide said fresh solvent fraction and said heavy oil fraction;

crude oil conduit means for conducting said crude oil to said first fractional distillation means;

solvent extraction means for obtaining a deasphalted heavy oil extract from said heavy oil fraction;

first conduit means for conducting said heavy oil fraction from said first fractional distillation means to said solvent extraction means;

solvent recovery means for recovering solvent from said deasphalted heavy oil extract to provide a solvent recycle stream and a rerun solvent stream;

extract conduit means for conducting said deasphalted heavy oil extract from said solvent extraction means to said solvent recovery means;

solvent recycle conduit means for conducting said solvent recycle stream from said solvent recovery means to said solvent extraction means;

second fractional distillation means for fractionating said fresh solvent fraction and said rerun solvent stream to produce a purified extraction solvent;

second conduit means for conducting said fresh solvent fraction from said first fractional distillation means to said second fractional distillation means;

third conduit means for conducting said rerun solvent stream from said solvent recovery means to said second fractional distillation means; and fourth conduit means for conducting said purified extraction solvent from said second fractional distillation means to said solvent extraction means.

2. The apparatus of claim 1 further comprising a heating means, disposed within said second conduit means and said third conduit means, for heating said fresh solvent fraction and said rerun solvent stream.

3. The apparatus of claim 1, wherein said second fractional distillation means comprises a distillation column.

4. The apparatus of claim 3, wherein said second fractional distillation means further comprises a plurality of feed nozzles connected to the side of said distillation column at different elevations, said second conduit means and said third conduit means being connected to said feed nozzles so that said fresh solvent fraction and said rerun solvent stream can be fed to said distillation column through any of said feed nozzles.

5. The apparatus of claim 4 wherein said feed nozzles are connected to the side of said distillation column within about the middle vertical one-third of said distillation column.

6. The apparatus of claim 3, wherein said second fractional distillation means further comprises a reboiler connected to the bottom portion of distillation column.

7. The apparatus of claim 3, wherein said second fractional distillation means further comprises at least one draw nozzle connected to the side of said distillation column, said fourth conduit means being connected to said draw nozzle.

8. The apparatus of claim 7 wherein said draw nozzle is connected to the side of said distillation column within about the middle vertical one-half of said distillation column.

* * * * *